United States Patent [19]

Chao et al.

[11] 4,104,036

[45] Aug. 1, 1978

[54] IRON-CONTAINING MOTOR FUEL COMPOSITIONS AND METHOD FOR USING SAME

[75] Inventors: Tai S. Chao, Homewood; Ernest H. Owston, Jr., Park Forest, both of Ill.

[73] Assignee: Atlantic Richfield Company, Philadelphia, Pa.

[21] Appl. No.: 664,731

[22] Filed: Mar. 8, 1976

[51] Int. Cl.[2] ..... C10L 1/18

[52] U.S. Cl. ..... 44/56; 44/68

[58] Field of Search ..... 44/56, 57, 68, 70

[56] References Cited

U.S. PATENT DOCUMENTS

| | | | |
|---|---|---|---|
| 1,766,501 | 6/1930 | Buerk | 44/57 |
| 2,087,582 | 7/1937 | Schneider | 44/56 |
| 3,294,685 | 12/1966 | Stevens | 44/68 |

*Primary Examiner*—Daniel E. Wyman
*Assistant Examiner*—Mrs. Y. Harris-Smith
*Attorney, Agent, or Firm*—Frank J. Uxa

[57] ABSTRACT

An improved fuel composition comprising a major amount of hydrocarbons boiling in the gasoline boiling range, a minor amount of at least one hydrocarbon soluble compound of a metal selected from the group consisting of Group VIII metals and mixtures thereof capable of improving the octane number rating of the composition, a minor amount of at least one aliphatic alcohol containing from about 1 to about 8 carbon atoms per molecule; and a minor amount of at least one organic peroxy component containing from about 1 to about 20 carbon atoms per molecule wherein the compound and the combination of alcohol and peroxy component are present in mutually activating amounts to improve the octane number rating of the fuel composition.

An improved method for fueling an internal combustion engine using the composition described above is also disclosed.

14 Claims, No Drawings

IRON-CONTAINING MOTOR FUEL COMPOSITIONS AND METHOD FOR USING SAME

This invention relates to an improved fuel composition. More particularly, the invention relates to fuel compositions useful, for example, in fueling internal combustion engines, which have improved anti-knock properties.

Fuel compositions often include at least one additive to improve the anti-knock properties of the composition. The anti-knock properties of a fuel composition are directly related to, and often measured by, the octane number rating of the composition. Thus, if the octane number rating of a fuel composition increases, the anti-knock properties of that composition improve.

In recent years, fuel marketers have worked diligently to improve the octane number rating of fuel compositions. Because of the capital investment required, e.g., for additional petroleum refining capacity, to improve the inherent anti-knock properties of hydrocarbon-based fuel compositions, fuel additives which improve fuel anti-knock properties by a fraction of a single octane number represent a significant development. Therefore, a continuing need is apparent to provide additive systems for fuel compositions which increase the octane number rating of fuel compositions.

Therefore, one object of the present invention is to provide a fuel composition having improved anti-knock properties, as measured by improved octane number rating.

Another object of the present invention is to provide a method for fueling an internal combustion engine wherein improved engine performance, e.g., reduced tendency to knock, results. Other objects and advantages of the present invention will become apparent hereinafter.

An improved fuel composition, e.g., for fueling an internal combustion engine, has now been discovered. The composition comprises a major amount of hydrocarbons boiling in the gasoline boiling range; a minor amount of at least one hydrocarbonsoluble compound of a metal selected from the group consisting of Group VIII metals and mixtures thereof capable of improving the octane number rating of the composition; a minor amount of at least one aliphatic alcohol containing from 1 to about 8, preferably from 1 to about 4, carbon atoms per molecule; and a minor amount of at least one organic peroxy component containing from 1 to about 20 carbon atoms per molecule, wherein the compound and the combination of alcohol and peroxy component are present in mutually activating amounts to improve the octane number rating of the fuel composition. Thus, minor amounts of at least one of certain metal compounds, aliphatic alcohols and organic peroxy components provide a hydrocarbon fuel composition having an unexpectedly improved octane number rating. These compositions may be used in an improved method of fueling an internal combustion engine to achieve outstanding benefits, e.g., reduced tendency of the engine to knock during operation.

The base fuel of the invention comprises a mixture of hydrocarbons boiling in the gasoline boiling range. Typically, the base fuel comprises hydrocarbons which boil primarily in the gasoline boiling range, i.e., from about 50° F. to about 500° F. This base fuel may consist of straight chain or branched chain paraffins, cycloparaffins, olefins and aromatic hydrocarbons or any mixture of these. This fuel can be derived from straight run naphtha, alkylate gasoline, polymer gasoline, natural gasoline or from catalytically cracked or thermally cracked hydrocarbons and catalytically reformed stocks. The composition of the base fuel is not critical nor does the octane level of the base fuel have any substantial material effect on the invention. Any conventional substantially hydrocarbon motor fuel base may be employed in the practice of this invention. Preferably, the hydrocarbons boiling in the gasoline boiling range comprise at least about 70%, more preferably at least about 80%, by volume of the present fuel compositions.

The base fuel may contain any of the additives normally employed in a motor fuel. For example, the base fuel may contain anti-icing agents, detergents, demulsifiers, corrosion inhibitors, dyes, deposit modifiers, lead scavengers, multipurpose additives and the like. In addition, the present base fuel may include other conventional anti-knock components, such as tetraalkyl lead compounds including tetraethyl lead, tetramethyl lead, tetrabutyl lead, mixtures thereof and the like. However, preferably, the present fuel compositions are substantially lead free.

In one embodiment of the present invention, the presently useful metal compounds can be represented by the following structure

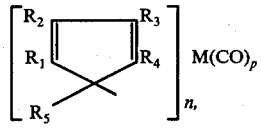

and mixtures thereof, wherein each $R_1$, $R_2$, $R_3$, $R_4$ and $R_5$ is independently, i.e., can be the same or different, selected from the group consisting of hydrogen and monovalent substantially hydrocarbonaceous radicals containing from 1 to about 20, preferably from 1 to about 10, carbon atoms; $n$ is an integer equal to 1 or 2 and $p$ is an integer equal to zero to 3, provided that when $n$ is 1, $p$ is from 1 to 3 and when $n$ is 2, $p$ is zero; and M is a metallic element selected from the group consisting of Group VIII metals and mixtures thereof, preferably iron, nickel, cobalt and mixtures thereof and more preferably iron. Preferably, $n$ is 2 and $p$ is equal to zero. The term "substantially hydrocarbonaceous radicals" referred to above, includes those radicals which are compounds primarily of carbon and hydrogen and also includes radicals which contain, in addition, minor amounts of substituents, such as oxygen, halide, sulfur, nitrogen and the like which do not substantially affect the hydrocarbon character of the radicals.

Thus, the $R_1$, $R_2$, $R_3$, $R_4$ and $R_5$ groups of the above metal-containing compounds can be alkyl radicals such as, for example, methyl, ethyl, n-propyl, isopropyl, n-butyl, isobutyl, sec-butyl, t-butyl, n-amyl, and the various positional isomers thereof as, for example, 1-methyl-butyl, 2-methyl-butyl, 3-methyl-butyl, 1,1-dimethyl-propyl, 1,2-dimethyl-propyl, 2,2-dimethyl-propyl, and 1-ethyl-propyl, and likewise the corresponding straight and branched chain isomers, of hexyl, heptyl, octyl, nonyl, decyl, undecyl, dodecyl, tridecyl, tetradecyl, pentadecyl, hexadecyl, heptadecyl, octodecyl, nondecyl, eicosyl and the like. In addition, these monovalent substantially hydrocarbon radicals may be alkenyl radicals such as ethyl, $\Delta^1$-propenyl, $\Delta^2$-propenyl, isopropenyl, $\Delta^1$-butenyl, $\Delta^2$-butenyl, $\Delta^3$-butenyl, and the corresponding branched chain isomers thereof as, for example, $\Delta^1$-isobutenyl, $\Delta^2$-isobutenyl, $\Delta^1$-sec-butenyl, $\Delta^2$-sec-butenyl, including 1-methylene-$\Delta^2$-propenyl, $\Delta^1$-pentenyl, $\Delta^2$-pentenyl $\Delta^3$-pentenyl, $\Delta^4$-pentenyl, and the corresponding branched chain isomers thereof; $\Delta^1$-hexenyl, $\Delta^2$-hexenyl, $\Delta^3$-hexenyl, $\Delta^4$-hexenyl, $\Delta^5$-hexenyl, and the corresponding branched chain isomers thereof, including 3,3-dimethyl-$\Delta^1$-butenyl; 2,3-dimethyl-$\Delta^1$-butenyl; 2,3-dimethyl-$\Delta^2$-butenyl; 2,3-dimethyl-$\Delta^3$-butenyl; and 1-methyl-1-ethyl-$\Delta^2$-propenyl; and similarly, the various isomers of heptenyl, octenyl, nonyl, decenyl, undecenyl, dodecenyl, tridecenyl, tetradecenyl, pentadecenyl, eicosenyl and the like.

In addition, the $R_1$, $R_2$, $R_3$, $R_4$, and $R_5$ groups can be aryl radicals, such as, for example, phenyl, $\alpha$-naphthyl, $\beta$-naphthyl, $\alpha$-anthryl, $\beta$-anthryl, $\gamma$-anthryl, and the like including the various monovalent radicals of such aromatics, e.g., indene, isoindene, acenaphthene, fluorene, phenanthrene, naphthacene, chrysene, pyrene, triphenylene, and the like.

In addition, the $R_1$, $R_2$, $R_3$, $R_4$ and $R_5$ groups can be aralkyl radicals such as, for example, benzyl, $\alpha$-phenyl-ethyl, $\beta$-phenyl-ethyl, $\alpha$-phenyl-propyl, $\beta$-phenyl-propyl, $\gamma$-phenyl-propyl, $\alpha$-phenyl-isopropyl, $\beta$-phenyl-isopropyl, $\alpha$-phenyl-butyl, $\beta$-phenyl-butyl, $\gamma$-phenyl-butyl, $\delta$-phenyl-butyl, $\alpha$-phenyl-isobutyl, $\beta$-henyl-isobutyl, $\gamma$-phenyl-isobutyl, $\alpha$-phenyl-sec-butyl, $\beta$-henyl-sec-butyl, $\gamma$-phenyl-sec-butyl, $\beta$-phenyl-t-butyl, $\alpha'$-naphthyl-methyl, $\beta'$-naphthyl-methyl, $\alpha$-($\alpha'$-naphthyl)-ethyl, $\alpha$-($\beta'$-naphthyl)-ethyl, $\beta$-($\alpha'$-naphthyl)-ethyl, $\beta$-($\beta'$-naphthyl)-ethyl, $\alpha$-($\alpha'$-naphthyl)-propyl, $\alpha$-($\beta'$-naphthyl)-propyl, $\beta$-($\alpha'$-naphthyl)-propyl, $\beta$-($\beta'$-naphthyl)-propyl, $\gamma$-($\alpha'$-naphthyl)-propyl, $\gamma$-($\beta'$-naphthyl)-propyl, $\alpha$-($\alpha'$-naphthyl)-isopropyl, $\alpha$-($\beta'$-naphthyl)-isopropyl, $\alpha$-($\alpha'$-naphthyl)butyl, $\alpha$-($\beta'$-naphthyl)-butyl, $\beta$-($\alpha'$-naphthyl)-butyl, $\beta$-($\beta'$-naphthyl)-butyl, $\gamma$-($\alpha'$-naphthyl)-butyl, $\gamma$-($\beta'$-naphthyl)-butyl, $\delta$-($\alpha'$-naphthyl)-butyl, $\delta$-($\beta'$naphthyl)-butyl, $\alpha$-($\alpha'$-naphthyl)-isobutyl, $\alpha$-($\beta'$-naphthyl)-isobutyl, $\beta$-($\alpha'$-naphthyl)-isobutyl, $\beta$-($\beta'$-naphthyl)-isobutyl, $\gamma$-($\alpha'$-naphthyl)-isobutyl, $\gamma$-($\beta'$-naphthyl)-isobutyl, $\alpha$-($\alpha'$-naphthyl)-sec-butyl, $\alpha$-($\beta'$-naphthyl)-sec-butyl, $\beta$-($\alpha'$-naphthyl)-sec-butyl, $\beta$-($\beta'$-naphthyl)-sec-butyl, $\gamma$-($\alpha'$-naphthyl)-sec-butyl, $\gamma$-($\beta'$-naphthyl)-sec-butyl, $\beta$-($\alpha'$-naphthyl)-t-butyl, $\beta$-($\beta'$-naphthyl)-t-butyl, the corresponding $\alpha'$- and $\beta'$-naphthyl derivatives of n-amyl and the various positional isomers thereof such as, for example, said derivatives of 1-methyl-butyl, 2-methyl-butyl, 3-methyl-butyl, 1,1-dimethyl-propyl, 1,2-dimethyl-propyl, 2,2-dimethyl-propyl, 1-ethyl-propyl, and likewise said derivatives of the corresponding isomers of hexyl, heptyl, octyl, and the like, including eicosyl. Other such aralkyl derivatives of the metal-containing compounds useful in the present invention include the $\alpha'$- and $\beta'$-, and $\gamma'$-anthyl derivatives of alkyl radicals, such as, for example, $\alpha'$-anthryl-methyl, $\alpha$-($\beta'$-anthryl)-ethyl, $\beta$-($\gamma'$-anthryl)-ethyl, $\alpha$-($\alpha'$-anthryl)-butyl, $\delta$-($\beta'$-anthryl)-2-methyl-amyl, and the like and the corresponding alkyl derivatives of phenanthrene, fluorene, acenaphthene, chrysene, pyrene, triphenylene, naphthacene, and the like.

In addition, the $R_1$, $R_2$, $R_3$, $R_4$ and $R_5$ groups of the above-described metal-containing compounds can be alkaryl such as, for example, o-tolyl, m-tolyl, p-tolyl, o-ethylphenyl, m-ethylphenyl, p-ethylphenyl, o-n-propylphenyl, m-n-propylphenyl, p-n-propylphenyl, o-isopropylphenyl, m-iso-propylphenyl, p-isopropylphenyl, 2-methyl-$\alpha$-naphthyl, 3-methyl-$\alpha$-naphthyl, 4-methyl-$\alpha$-naphthyl, 5-methyl-$\alpha$-naphthyl, 6-methyl-$\alpha$-naphthyl, 7-methyl-$\alpha$-naphthyl, 8-methyl-$\alpha$-naphthyl, 1-ethyl-$\beta$-naphthyl, 3-ethyl-$\beta$-naphthyl, 4-ethyl-$\beta$-naphthyl, 5-ethyl-$\beta$-naphthyl, 6-ethyl-$\beta$-naphthyl, 7-ethyl-$\beta$-naphthyl, 8-ethyl-$\beta$-naphthyl, 2,3-di-propyl-$\alpha$-naphthyl, 5,8-di-isopropyl-$\beta$-naphthyl, and the like.

Further, the cyclopentadienyl moiety of the abovedescribed metal-containing compounds can be directly bonded with at least one fused ring structure, thereby providing an organic ring-containing cyclopentadienyl moiety. The organic ring structure fused with the cyclopentadienyl moiety can be alicyclic or aromatic. When this structure is alicyclic, thereis provided a series of compounds which can be represented

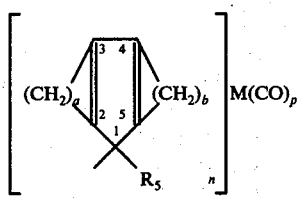

wherein $a$ and $b$ can be the same or different and are small whole integers including zero and excluding one, wherein $n$, $p$ and M are as described heretofore, and wherein $R_5$ is selected from the class consisting of hydrogen and monovalent substantially hydrocarbon radicals, as described heretofore. Thus, when $a$ is zero, each of the carbon atoms designated as 2 and 3 have attached thereto a monovalent radical selected from the class consisting of hydrogen and substantially hydrocarbon radicals. Furthermore, the monovalent radicals so attached can be the same or different. The same discretion applies to each of the carbon atoms designated as 4 and 5 when $b$ is zero.

In an additional embodiment, the present metal-containing compounds are represented by the following structure $$[R_1\overset{\overset{\displaystyle O}{\|}}{C}-A]_nM(CO)_p$$

wherein A is a cyclomatic hydrocarbon radical having from 5 to about 25 carbon atoms which embodies a group of 5 carbons having the configuration found in cyclopentadiene, $R_1$ is a monovalent substantially hydrocarbon radical as defined heretofore and M, $n$ and $p$ are as defined hereinbefore, the compounds being further characterized in that the cyclomatic hydrocarbon radical is bonded to the metal by carbon-to-metal bonds through carbons of the cyclopentadienyl group. In a preferred embodiment, as before, $n$ is equal to 2 and $p$ is equal to zero.

Illustrative examples of the presently useful metal-containing compounds include the following: bis-cyclopentadienyl iron (ferrocene), cyclopentadienyl iron tricarbony, cyclopentadienyl iron dicarbonyl (available as a dimer), bis-(1-methyl-cyclopentadienyl) iron, 1-methyl-cyclopentadienyl iron tricarbonyl, methyl cyclopentadienyl dicarbonyl (available as a dimer), bis-(3-ethyl-cyclopentadienyl) iron, 3-ethyl-cyclopentadienyl iron tricarbony, di-methyl amino methyl ferrocene, hydroxy methyl ferrocene, ethyl ferrocene, bis-(4-n-propyl-cyclopentadienyl) iron, 4-n-propyl-cyclopentadienyl iron tricarbonyl, n-butyl ferrocene, t-butyl ferrocene, bis-(2,3-di-n-butyl-cyclopentadienyl) iron, 2,3-di-n-butyl-cyclopentadienyl iron tricarbonyl, bis-(2,4-di-sec-butyl-cyclopentadienyl) iron, 2,4-di-sec-butyl-cyclopentadienyl iron tricarbonyl, bis-(2,5-di-tert-butyl-cyclopentadienyl) iron, 2,5-di-tert-butyl-cyclopentadienyl iron tricarbonyl, bis-(neopentyl-cyclopentadienyl) iron, t-octyl ferrocene, bis-(2-phenyl-cyclopentadienyl) iron, 2-phenyl-cyclopentadienyl) iron tricarbonyl, bis-(4-(α-naphthyl)-cyclopentadienyl) iron, 4-(α-naphthyl)-cyclopentadienyl iron tricarbonyl, bis-(3-benzyl-cyclopentadienyl) iron, 3-benzyl-cyclopentadienyl iron tricarbonyl, bis-(4-(α-phenylethyl)-cyclopentadienyl) iron, 4-(α-phenylethyl)-cyclopentadienyl iron tricarbonyl, bis-(3-(β-phenylethyl-cyclopentadienyl) iron, 3-(β-phenylethyl-cyclopentadienyl) iron tricarbonyl, bis-(3,4-di-(α-phenyl-butyl)-cyclopentadienyl) iron, 3,4-di-(α-phenyl-butyl)-cyclopentadienyl iron tricarbonyl, bis-(2-benzyl-cyclopentadienyl) iron, 2-benzyl-cyclopentadienyl iron tricarbonyl, bis-(3-benzyl-cyclopentadienyl) iron, 3-benzyl-cyclopentadienyl iron tricarbonyl, acetyl ferrocene, di-acetyl ferrocene, di-benzoyl ferrocene, bis-(3-o-tolyl-cyclopentadienyl) iron, 3-o-tolyl-cyclopentadienyl iron tricarbonyl, bis-(4-m-tolyl-cyclopentadienyl) iron, 4-m-toly-cyclopentadienyl iron tricarbonyl, bis-(3-p-tolyl-cyclopentadienyl) iron, 3-p-tolyl-cyclopentadienyl iron tricarbonyl, bis-(3-o-ethylphenyl-cyclopentadienyl) iron, 3-o-ethylphenyl-cyclopentadienyl iron tricarbonyl, bis-(2-m-ethylphenyl-cyclopentadienyl) iron, 2-m-ethylphenyl- cyclopentadienyl iron tricarbonyl, bis-(4,5,6,7-tetra- hydroindenyl) iron, 4,5,6,7-tetrahydroindenyl iron tricarbonyl, bis-(1,2,3,4,5,6,7,8,-octa-hydrofluorenyl) iron, 1,2,3,4,5,6,7,8,-octa-hydrofluorenyl iron tricarbonyl, bis-(3-methyl-4,5-,6,7,tetrahydroindenyl) iron, 3-methyl-4,5,6,7, tetrahydroindenyl iron tricarbonyl, bis-(indenyl) iron, bis-(4,7-dimethyl indenyl) iron, 4,7-dimethyl indenyl iron tricarbonyl, bis-(4,phenyl fluorenyl) iron, 4,phenyl fluorenyl iron tricarbonyl, bis-(3-methyl-4,6-diethyl indenyl) iron, 3-methyl-4,6-diethyl indenyl iron tricarbonyl, indenyl iron tricarbonyl, bis-fluorenyl iron, fluorenyl iron tricarbonyl, bis-(butyl-indenyl) iron, butyl-indenyl iron tricarbonyl, bis-(sec-butyl-fluorenyl) iron, sec-butyl-fluorenyl iron tricarbonyl, bis-(isobutyl-3-methyl-cyclopentadienyl) iron, isobutyl-3-methyl-cyclopentadienyl iron tricarbonyl, bis-(t-butyl-5-o-tolyl-fluorenyl) iron, t-butyl-5-o-tolyl-fluorenyl iron tricarbonyl, bis-(ethyl-di(cyclopentadienyl) iron, ethyl-di(cyclopentadienyl) iron tricarbonyl, bis-(di-ethyl-indenyl)-iron, di-ethyl-indenyl iron tricarbonyl, methylpropionyl cyclopentadienyl iron tricarbonyl, acetyl cyclopentadienyl iron tricarbonyl, benzoyl cyclopentadienyl iron tricarbonyl, 3-methyl-5-ethylbenzoyl-isopropyl cyclopentadienyl iron tricarbonyl, β,β-diethylpropionylindenyl iron tricarbonyl, benzylacetyl cyclopentadienyl iron tricarbonyl and 3-n-propyl-6-ethylbenzoyl cyclopentadienyl iron tricarbonyl. Corresponding compounds of the other Group VIII metals are also suitable for use in the present invention.

The aliphatic alcohols useful in the present invention often contain from 1 to about 8, preferably from 1 to about 4, carbon atoms per molecule. Preferably, the alcohols are monohydroxy alcohols. Such alcohols are conventional and well known in the art. Included among these alcohols are methyl alcohol, ethyl alcohol, n-propyl alcohol, iso-propyl alcohol, n-butyl alcohol, sec-butyl alcohol, t-butyl alcohol, amyl alcohols, hexyl alcohols, heptyl alcohols, octyl alcohols and mixtures thereof. In a particularly preferred embodiment of the present invention, t-butyl alcohol is employed. The alcohol is preferably included in an amount which is soluble in the present fuel composition at room temperature, e.g., about 60° to about 80° F. Preferably, the alcohol comprises from about 0.001% to about 20%, more preferably from about 0.5% to about 12%, by volume of the total fuel composition.

At least one of certain organic peroxy components is an additional essential part of the present invention. The organic peroxy components which may be used in the present compositions include organic peroxides, organic hydroperoxides, organic peracids, organic peresters and mixtures thereof which contain from 1 to about 20, preferably from 1 to about 8 and more preferably from 1 to about 4, carbon atoms per molecule. Such peroxy components may be present, for example, as a minor byproduct from the manufacture of the alcohol or alcohols useful in the present invention. The organic peroxy components suitable for use include, by way of example, hydrocarbon peroxides, hydrocarbon hydroperoxides, and hydrocarbon peracids wherein the hydrocarbon radicals in general contain up to about 20 carbon atoms per molecule. With respect to the hydrocarbon peroxides and peresters, the hydrocarbon radical is defined as that radical which is attached to the carbonyl carbon. It is intended that the term organic peracid include, by way of definition, performic acid and the term organic perester include, by way of definition, performates. Also, peroxy components which include more than one active oxygen atom per molecule are suitable for use and are included within the scope of the present invention.

In certain instances, the peroxy component which is an essential constituent of the present composition is present as a contaminant in the aliphatic alcohols which are useful in the present compositions. For example, in the manufacture of t-butyl alcohol by oxidation of ix-obutane, the alcohol product contains from about 5 ppm. to about 200 ppm. by weight of t-butyl hydroperoxide. Such alcohol-peroxy component combinations are useful in the present invention. Of course, the alcohol and peroxy component constituents of the present compositions may be prepared separately and combined together, for example, when preparing the compositions of the present invention.

Typical examples of hydrocarbon radicals are alkyl such as methyl, ethyl, butyl, t-butyl, pentyl, n-octyl and those aliphatic radicals which represent the hydrocarbon portion of a middle distillate of kerosene, and the like; cycloalkyl radicals such as cyclopentyl and the like; alkylated cycloalkyl radicals such as mono- and polymethylcyclo-entyl radicals and the like; aryl radicals such as phenyl, naphthyl and the like; cycloalkyl substituted alkyl radicals such as cyclohexyl methyl and ethyl radicals and the like; alkyl phenyl substituted alkyl radicals examples of which are benzyl, methylbenzyl, caprylbenzyl, phenylethyl, phenylpropyl, naphthylmethyl, naphthylethyl and the like; alkaryl radicals such as xylyl, methylphenyl and ethylphenyl and the like radicals.

Typical examples of suitable peroxy components include hydroxyheptyl peroxide, cyclohexanone peroxide, tertiary butyl peracetate, di-tertiary butyl diperphthalate, tertiary butyl perbenzoate, methyl ethyl ketone peroxide, dicumyl peroxide, tertiary butyl hydroperoxide, di-tertiary butyl peroxide, p-methane hydroperoxide, pinane hydroperoxide, 2,5-dimethylhexane-2,5-dihydroperoxide, cumene hydroperoxide and the like; as well as organic peracids such as performic acid, peracetic acid, trichloroperacetic acid, perbenzoic acid, perphthalic acid and the like. Alkyl hydroperoxides containing from 1 to about 8, more preferably from 1 to about 4, carbon atoms per molecule are the preferred peroxy component, with tertiary butyl hydroperoxide being most preferred.

Such peroxy components are preferably present in the compositions of the present invention in an amount from about 1 part per million (ppm.) to about 500 ppm., more preferably from about 1 ppm. to about 100 ppm., by weight of the total composition.

The present compositions are useful in fueling an internal combustion engine and provide outstanding benefits, e.g., reduced tendency of the engine to knock during operation. Conventionally, a fuel composition such as the present compositions, is combined with air in at least one carburetor and combusted in the combustion chamber or chambers of an internal combustion engine. Since it is preferred that the present fuel compositions be available for transport to the carburetor in a single stable liquid phase, it is preferred that only a single injection means be used to feed the compositions to the carburetor. However, it is also within the scope of the present invention that one or more of the essential components of the present compositions be fed to the engine by separate injection means. In any event, at combustion, the present fuel compositions achieve outstanding benefits, e.g., improved engine anti-knock properties.

The following examples illustrate more clearly the method of the present invention. However, these illustrations are not to be interpreted as specific limitations on this invention.

EXAMPLES

These examples illustrate certain of the benefits of the present invention.

A number of fuel compositions were prepared with sufficient blending to insure uniform composition. Each of these compositions included a base gasoline having the following average characteristics:

| | | |
|---|---|---|
| Mass Spec Type Analysis | | Vol.% |
| Paraffins | | 92.9 |
| Naphthenes | | 5.1 |
| Aromatics | | 2.0 |
| ASTM (D-86) | | |
| | Initial | 99° F. |
| | 10% | 130° F. |
| | 50% | 207° F. |
| | 90% 298° F. | |
| | EP | 405° F. |

Certain of these fuel compositions, as shown in Table 1, included one or more of the following components:

A. A commercially available iron-containing additive system capable of increasing the octane number rating of fuel compositions. The primary iron-containing compound in this additive system is bis-cyclopentadienyl iron, i.e., ferrocenes.

B. Tertiary butyl alcohol, designated in Table I as "TBA."

C. Tertiary butyl hydroperoxide, designated in Table I as TBOOH.

Each of the compositions thus prepared was tested for octane number by both motor (ASTM D-357-47) and research methods (ASTM D-908-47T). Results of these octane number determinations and certain other calculations are summarized in Table I.

TABLE I

| Composition | TBA, Vol.% | Ferrocene Content gm./gal. | TBOOH Content (1) | Octane Research Number (RON) | Motor Method Octane Number (MON | $\frac{RON + MON}{2}$ | $\frac{RON + MON}{2}$ Change from Comp. 1 | Extra $\frac{RON + MON}{2}$ Resulting from Combination of Iron, TBA and TBOOH |
|---|---|---|---|---|---|---|---|---|
| 1 | — | — | — | 82.7 | 82.1 | 82.4 | — | — |
| 2 | — | 0.3 | — | 86.0 | 84.0 | 85.0 | 2.60 | — |
| 3 | 7% | — | 100 | 82.4 | 83.2 | 82.8 | 0.40 | — |
| 4 | 7% | 0.3 | 100 | 86.9 | 84.5 | 85.7 | 3.30 | 0.30 |

(1) Parts per million by volume, based upon concentration of TBA.

The results summarized in Table I clearly demonstrate the outstanding improvement in octane number rating of the present fuel compositions. For example, a composition which includes both iron-containing compound and a combination of tertiary butyl alcohol and tertiary butyl hydroperoxide (composition 4) has an octane number rating about 0.3 of a number higher than the expected simple additive effects of each of these components separately.

In short, these data make clear that a fuel composition including at least one compound of a metal selected from the Group VIII metals and mixtures thereof, a minor amount of at least one aliphatic alcohol containing from 1 to about 8 carbon atoms and a minor amount of an organic peroxy compound containing from 1 to about 20 carbon atoms provide outstandingly improved octane number ratings.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. A fuel composition comprising a major amount of hydrocarbons boiling in the gasoline boiling range; a minor amount capable of improving the octane rating of said composition of at least one hydrocarbon-soluble compound of iron; a minor amount of at least one aliphatic alcohol containing from 1 to about 8 carbon atoms and a minor amount of at least one organic peroxy component containing from 1 to about 20 carbon atoms, wherein said iron compound and the combination of said alcohol and said component are present in mutually activating amounts to improve the octane number rating of said fuel composition.

2. The composition of claim 1 wherein said metal is present in said composition in an amount from about 0.01 grams./gal. to about 10 grams./gal., calculated as elemental metal, said alcohol is present in an amount from about 0.001% to about 20% by volume of said composition, and said peroxy component is present in an amount from about 1 ppm. to about 500 ppm. by volume of said composition.

3. The composition of claim 2 wherein said metal is iron and said alcohol is monohydroxy.

4. The composition of claim 3 wherein said alcohol contains from 1 to about 4 carbon atoms per molecule.

5. The composition of claim 4 wherein said iron is present in said composition in an amount from about 0.05 grams./gal. to about 6 grams./gal., calculated as elemental iron, said alcohol is present in an amount from about 0.5% to about 12% by volume of said composition and said peroxy component is present in an amount from about 1 ppm. to about 100 ppm. by volume of said composition.

6. The composition of claim 5 wherein said alcohol is tertiary butyl alcohol and said peroxy component is tertiary butyl hydroperoxide.

7. The composition of claim 6 wherein said compound of iron includes a group of 5 carbon atoms having the configuration found in cyclopentadiene.

8. The composition of claim 7 wherein said compound of iron is bis-cyclopentadienyl iron.

9. In a method for operating an internal combustion engine, the improvement which comprises fueling said engine with the composition of claim 1.

10. In a method for operating an internal combustion engine, the improvement which comprises fueling said engine with the composition of claim 2.

11. In a method for operating an internal combustion engine, the improvement which comprises fueling said engine with the composition of claim 5.

12. In a method for operating an internal combustion engine, the improvement which comprises fueling said engine with the composition of claim 6.

13. In a method for operating an internal combustion engine, the improvement which comprises fueling said engine with the composition of claim 7.

14. In a method for operating an internal combustion engine, the improvement which comprises fueling said engine with the composition of claim 8.

* * * * *